US005674010A

United States Patent [19]

Dussich

[11] Patent Number: 5,674,010

[45] Date of Patent: Oct. 7, 1997

[54] RESEALABLE BAG

[76] Inventor: Vincent A. Dussich, 28 White Birch Rd., Madison, Conn. 06443

[21] Appl. No.: 563,332

[22] Filed: Nov. 28, 1995

[51] Int. Cl.[6] ..... B65D 33/30

[52] U.S. Cl. ..... 383/70; 383/89; 383/905; 383/908

[58] Field of Search ..... 383/89, 905, 908, 383/70

[56] References Cited

U.S. PATENT DOCUMENTS

| | | | |
|---|---|---|---|
| 220,510 | 10/1879 | Weaver | 383/905 |
| 651,937 | 6/1900 | Short . | |
| 1,087,702 | 2/1914 | Van Patten | 383/905 |
| 1,608,901 | 11/1926 | Miller | 383/905 |
| 1,698,462 | 1/1929 | Aasen | 383/905 |
| 3,201,030 | 8/1965 | Pollack | 383/905 |
| 3,402,052 | 9/1968 | Walker | 99/172 |
| 3,754,371 | 8/1973 | Walker, III | 383/905 |
| 3,990,626 | 11/1976 | Goodrich | 383/908 |
| 4,603,537 | 8/1986 | Pace | 383/905 |
| 4,810,103 | 3/1989 | Bell | 383/70 |
| 5,044,774 | 9/1991 | Bullard et al. | 383/34.1 |
| 5,184,896 | 2/1993 | Hammond et al. | 385/33 |
| 5,346,311 | 9/1994 | Siler et al. | 383/75 |

*Primary Examiner*—Stephen P. Garbe
*Attorney, Agent, or Firm*—Morrison Law Firm

[57] ABSTRACT

A resealable bag is formed of flexible sheet material having, embedded therein, a number of parallel, spaced apart strips of inelastic but bendable material which are capable of assuming a set position when bent. The strips, which extend generally longitudinally along the full length of the bags, each include a substantially widened portion, near the mouth of the bag, which co-operates with the flexible package walls to form a closure for resealing the package. A series of filled bags may be formed by first forming a continuous length of a flexible two-ply sheet material having a number of strips disposed between the plies. The end of the sheet is drawn past a hollow mandrel so as to bring the sheet edges into overlapping relation. The overlapped edges are joined to form a tube, the end of which is sealed with a transverse seam to form an open-ended bag. The open bag is then filled through the mandrel, sealed with a transverse seam and severed from the length of material.

4 Claims, 2 Drawing Sheets

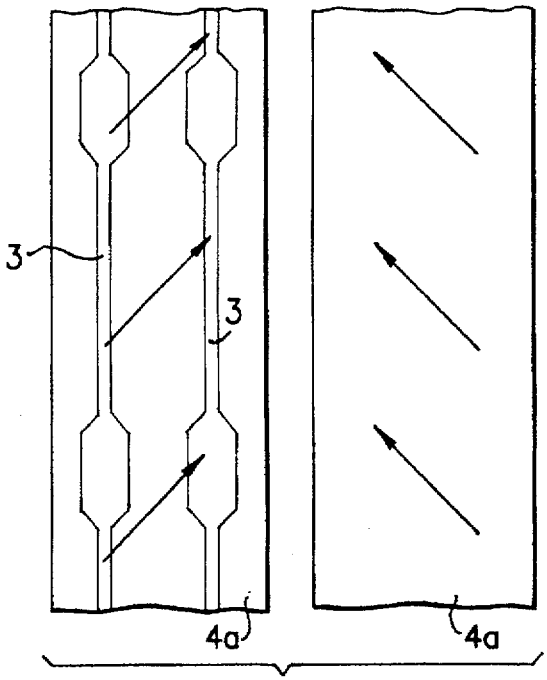
FIG. 4
FIG. 5
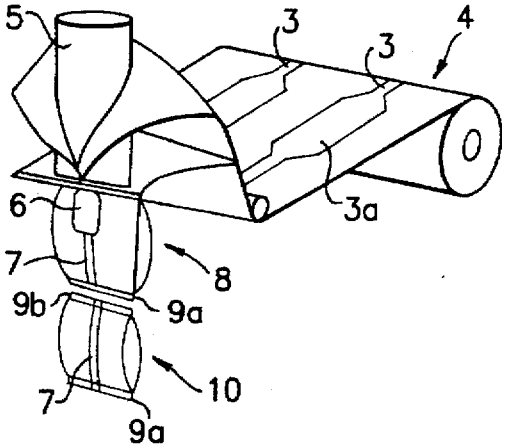
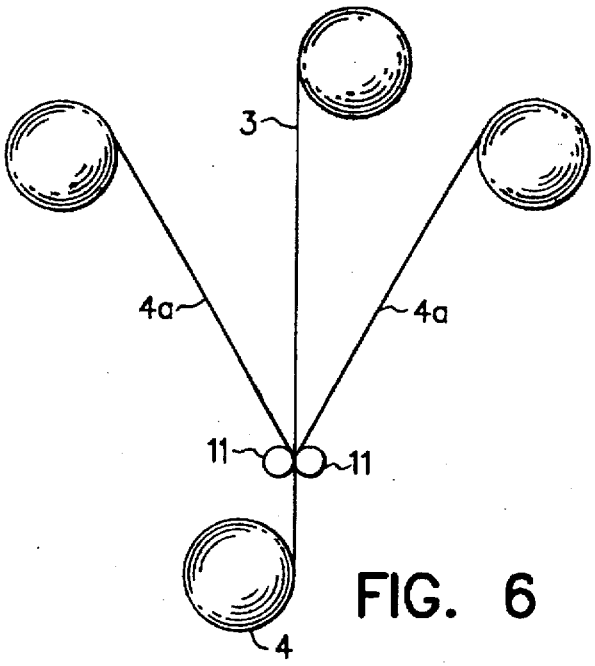
FIG. 6

RESEALABLE BAG

BACKGROUND AND SUMMARY OF THE INVENTION

The present invention pertains to a resealable flexible package, or bag, and to a method for forming and filling the same.

Many food items, especially snack foods, are packaged in flexible packages or bags. These packages, which are commonly formed of plastic materials, such as cellophane or polyethylene, are heat-sealed after filling to provide a closure impervious to moisture or micro-organisms. In the unopened condition, such packages serve admirably to maintain the freshness of their contents. Problems arise, however, when the entire contents of the package are not consumed upon opening. Although it is possible to reclose the package by folding or twisting, such reclosed packages do not remain in the reclosed condition. Rather, they tend to unfold or untwist, such that an effective closure is not maintained and the remaining contents become stale or spoiled.

Efforts to overcome this problem generally involve the use of a separate closure device such as a spring-loaded clip, or a plastic, or plastic-coated wire tie member. Such closure devices are effective when used, but are inconvenient as they are not always available when and where needed.

It is, therefore, a primary object of the present invention to provide a flexible package, or bag, which may be conveniently and effectively resealed.

It is another object to provide such a package which may be so resealed without the use of a separate closure device.

It is yet another object to provide such a package which may be inexpensively produced and filled.

The foregoing and other objects and advantages of the invention are achieved by a package formed of flexible sheet material, wherein a plurality of parallel, spaced apart strips of inelastic but bendable material, which are capable of assuming a set position when bent, are disposed in at least one of the package walls. The strips extend generally longitudinally along the full length of the package. Each of the strips includes a substantially widened portion proximate to the package mouth, which co-operates with the flexible package walls to form a closure to reseal the package mouth. Preferably, the sheet material comprises two plies of a plastic material, with the strips disposed therebetween. Advantageously, at least one of the plies is of a molecularly oriented material and the strips are disposed at an angle of about 45° relative to the orientation of the material.

A series of filled packages, of the type above-described, is formed by first forming a continuous length of a flexible two-ply sheet material having, disposed between the plies, a number of strips of an inelastic but bendable material; drawing the end of the sheet past a hollow mandrel, so as to bring the sheet edges into overlapping relation; joining the overlapped edges to form a tube; sealing the distal end of the tube to form an open-ended package; filling the package through the mandrel; sealing the filled package; and severing the filled and sealed package from the length of material.

BRIEF DESCRIPTION OF THE DRAWINGS

FIG. 4 is a fragmentary exploded view of a sheet of material for fabricating a series of packages in accord with the present invention;

FIG. 5 is an illustration of the process of fabricating a series of filled packages in accord with the present invention; and FIG. 6 is an illustration of the process of forming a sheet of material for use in fabricating a series of packages.

DESCRIPTION OF THE PREFERRED EMBODIMENT

Figure 1:
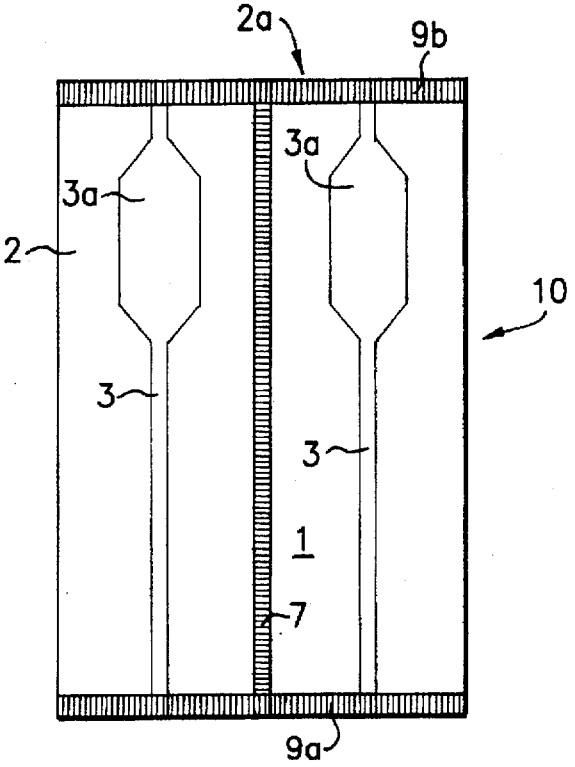
FIG. 1 is a front plan view of a package in accord with the present invention.
Figure 2:
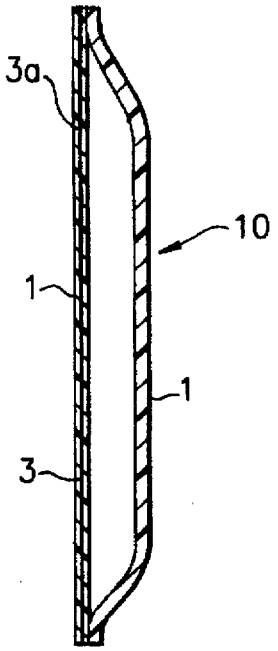
FIG. 2 is a side cross-sectional view of the package of FIG. 1.

Turning now to the drawing, there is seen, in FIG. 1, a package 10 comprised of flexible, heat sealable sheet material, having opposed walls 1 with an openable and recloseable end portion 2 providing a package mouth 2*a*. A number of strips 3 of inelastic but bendable material, which are capable of assuming a set position when bent, form part of at least one of package walls 1. Strips 3 are disposed in parallel, spaced apart relation, extending generally longitudinally for the full length of the package. Each of strips 3 includes a substantially widened portion 3*a* proximate to, but preferably spaced apart from package mouth 2*a*.

Figure 3:
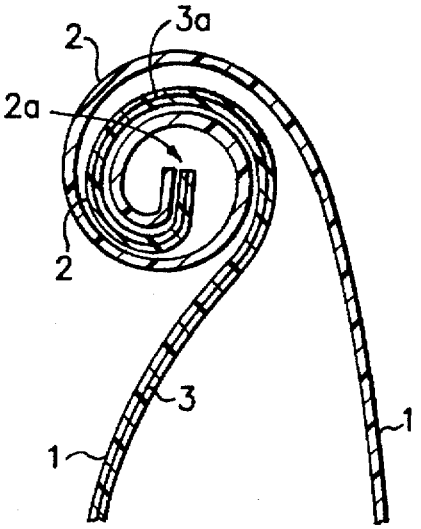
FIG. 3 is an enlarged, fragmentary side cross-sectional view of a resealed package in accord with the present invention.

Package mouth 2*a*, which is heat sealed after the package has been filled, is initially opened in the manner of conventional plastic packages, i.e. by pulling or tearing apart. Thereafter, package 10 may be resealed, as best seen in FIG. 3, by closing package mouth 2*a* and transversely folding end portion 2 a suitable number of times. During this folding, widened portions 3*a* of strips 3 assume a set position, serving to retain end portion 2 in a folded state, with package mouth 2*a* closed. Alternatively, package mouth 2*a* may be twisted shut. During this twisting, widened portions 3*a* of strips 3 assume a set position, serving to retain end portion 2 in a twisted state, with package mouth 2*a* closed.

Turning now to FIG. 5, there is shown a continuous roll of a flexible two-ply sheet material 4 having, disposed between plies 4*a*, 4*a*, a number of longitudinally extending strips 3, arranged in parallel. Although two strips are shown in this example, it will be appreciated that the preferred number of strips for any package is dependent upon the configuration of the widened portions 3*a* of strips 3, the size of the package, the weight of the package contents, and the materials employed. Likewise, the optimum dimensions of widened portions 3*a* are dependent upon the size of the package, the weight of the package contents and the stiffness of the materials selected for the sheet plies 4*a*, 4*a* and the strips 3. For example, if the width of widened portions 3*a* is increased, it should be possible to decrease the length thereof while still maintaining an effective resealing capability. Conversely, the width may be reduced if the length is increased. In this event, resealing would require more transverse folds, or twisting of a longer portion of the package. The width of the remainder of strips 3 need only be sufficient to maintain the integrity of the strips during fabrication of sheet material 4 as described in the following paragraph.

Sheet plies 4*a*, 4*a* may be formed of any suitable material, such as cellophane or polyethylene, which may be caused to adhere to each other so as to retain strips 3 therebetween. As shown in FIG. 6, sheet material 4 may be advantageously formed, in a continuous manner, from two rolls of material which are pressed together with strips 3, also arranged in rolls, brought therebetween and captured in the desired place as plies 4*a*, 4*a* are pressed together between rollers 11 which are preferably heated to a suitable temperature.

Advantageously, both of plies 4*a*, 4*a* are of a molecularly oriented material and, as shown in FIG. 4, strips 3 are disposed at an angle of about 45° relative to the orientation of the material. Such a construction provides maximum package strength and resistance to tearing of strips 3 through plies 4*a*, 4*a*. Less preferably, only one of plies 4*a*, 4*a* may be formed of an oriented material, while the other is formed from an unoriented material.

Turning now to FIG. 5, there is shown a process for the formation of a series of filled packages of the type above-described. The end of the sheet of material 4 is drawn past a hollow mandrel 5, so as to bring the edges thereof into overlapping relation. The overlapped edges are joined together, as they pass under heater 6, in a continuous, longitudinally extending seam 7, so as to form a tubular member 8. The distal end of tubular member 8 is then sealed with a transverse seam 9*a* to form an open-ended package having its open mouth wrapped around hollow mandrel 5. The package is then filled through mandrel 5. After filling, the top of the package is sealed with a transverse seam 9*b*; and the filled and sealed package 10 is severed from the sheet of material 4. Preferably, widened portions 3*a* of strips 3 are spaced apart a distance from the package mouth 2*a* to facilitate sealing and severing.

It is to be understood that the above-described steps are preferably performed in a continuous manner. Advantageously, top transverse seam 9*b* of one package is formed simultaneously with bottom transverse seam 9*a* of the following package in the series, and the filled and closed package at the end of the series is severed by slitting along the middle of the combined seams 9*a*, 9*b*.

It should further be understood that, while reference has been made to the preferred embodiment, various changes and alterations may be made thereto without departing from the spirit or contemplation of the invention, which is intended to be limited in scope only by the appended claims.

What is claimed is:

1. A package comprised of two plies of a flexible sheet material, having opposed walls and an openable and recloseable end portion providing a package mouth, and a plurality of parallel, spaced apart strips of inelastic but bendable material forming part of at least one of said walls and which are capable of assuming a set position when bent, said strips being disposed between said two plies and extending generally longitudinally of the package for the full length thereof, each of said strips including a substantially widened portion proximate to said package mouth, wherein said widened portions of said strips are adapted to co-operate with said flexible package walls to form a closure of said package mouth, at least one of said plies is of a molecularly oriented material and said strips are disposed at an angle of about 45° relative to the orientation of said oriented material.

2. The package of claim 1, wherein both of said plies are of a molecularly oriented material and said plies are disposed with their orientation at substantially right angles with respect to each other.

3. A package comprised of flexible sheet material, having opposed walls and an openable and recloseable end portion providing a package mouth, and a plurality of parallel, spaced apart strips of inelastic but bendable material forming part of at least one of said walls and which are capable of assuming a set position when bent, said strips extending generally longitudinally of the package for the full length thereof, each of said strips including a substantially widened portion proximate to said package mouth but spaced apart therefrom, wherein said widened portions are adapted to co-operate with said flexible package walls to form a closure of said package mouth sealable by folding or twisting.

4. The package of claim 3, wherein said flexible sheet material comprises two plies of a plastic material, with said strips disposed therebetween.

* * * * *